United States Patent [19]

DeSantis

[11] 4,061,453

[45] Dec. 6, 1977

[54] TOOLING FOR A POWDER COMPACTING PRESS

[75] Inventor: Raymond P. DeSantis, Royal Oak, Mich.

[73] Assignee: Wolverine Aluminum Corporation, Lincoln Park, Mich.

[21] Appl. No.: 761,333

[22] Filed: Jan. 21, 1977

Related U.S. Application Data

[63] Continuation of Ser. No. 619,856, Oct. 6, 1975, abandoned.

[51] Int. Cl.[2] ..... B30B 11/02

[52] U.S. Cl. ..... 425/78; 425/352; 425/410; 425/436 R

[58] Field of Search ..... 425/78, 116, 228, 408, 425/DIG. 44, DIG. 35, DIG. 116, 416

[56] References Cited

U.S. PATENT DOCUMENTS

| | | | |
|---|---|---|---|
| 994,349 | 6/1911 | Updegraff | 425/DIG. 116 |
| 2,714,226 | 8/1955 | Axelrod | 425/DIG. 44 |
| 2,777,162 | 1/1957 | Baughof | 425/DIG. 33 |
| 2,870,484 | 1/1959 | Livingston | 425/416 |
| 2,979,770 | 4/1961 | Greene et al. | 425/416 X |
| 3,059,305 | 10/1962 | Brozdowicz | 425/228 X |
| 3,129,464 | 4/1964 | Heider | 425/416 |
| 3,158,547 | 11/1964 | Smith | 425/416 X |
| 3,173,974 | 3/1965 | Mohr | 425/DIG. 44 |
| 3,255,279 | 6/1966 | Smith | 425/408 |
| 3,328,840 | 7/1967 | Vinson | 425/78 |
| 3,353,214 | 11/1967 | Schulze | 425/78 |
| 3,382,540 | 5/1968 | Van De Maden et al. | 425/78 |
| 3,775,032 | 11/1973 | Smith et al. | 425/78 |

*Primary Examiner*—J. Howard Flint, Jr.
*Attorney, Agent, or Firm*—Hauke & Patalidis

[57] ABSTRACT

An apparatus for compacting powder material into a mold cavity formed at least between an upper and a lower reciprocally movable punch. The lower punch reciprocates in the center bore of a die and has an end face defining a portion of the mold cavity. The upper punch is reciprocable so as to be placed over the die bore and has an end face defining another portion of the mold cavity. The upper punch end face is coated with, or made of, an elastomeric material. The upper face of the lower punch may be flat or contoured. The compaction of the powder material in the mold cavity is accomplished by the upward movement of the lower punch which forces the powder material to conform to the configuration of the mold cavity. After compaction, the upper punch is withdrawn and the compacted product is ejected.

5 Claims, 8 Drawing Figures

TOOLING FOR A POWDER COMPACTING PRESS

This is a continuation of application Ser. No. 619,856, filed Oct. 6, 1975, now abandoned.

BACKGROUND OF THE INVENTION

I. Field of the Invention

The present invention relates to powder compacting apparatus and, more particularly, to an apparatus which will produce a final product within very close dimensional tolerances and with uniform density.

II. Description of the Prior Art

The present invention is concerned with improved tooling for use in powder-compacting presses such as are disclosed in U.S. Pat. Nos. 3,826,559; 3,775,032; 3,730,659; 3,726,622; 3,645,658; 3,574,892; 3,561,056; 3,415,142; 3,344,213; and 3,328,840, all of which are assigned to the same assignee as the present application.

In the powder-compacting presses disclosed in the aforementioned U.S. patents, the articles are compacted and formed in a multi-cavity die forming part of a punch and die set, with the finished articles being automatically ejected from the die cavities, picked up by a vacuum pick-up head, and conveyed into suitable receptacles. A work station positioner assembly, which is part of the press, is mounted angularly movable transversely over the die plate and carries a powder dispenser, an anvil and the pick-up head. The powder dispenser, which is supplied with powder from a primary powder supply means connected thereto by means of a flexible tubing or the like, is first positioned over the die cavity or cavities which are thus filled with powder as the punches are displaced downwardly so as to draw a predetermined amount of powder into the die cavity or cavities. The dispenser is then removed from above the die cavity or cavities by the subsequent angular motion of the station positioner assembly, and the anvil is, in turn, positioned over the die cavities. The anvil is clamped over the die cavity by means of a pivotable clamp supported above the anvil and actuated in timed relation with the movement of the punches. The anvil is held down with sufficient pressure to permit the compaction of the powder against the anvil as a result of an upward motion of the punches into the die cavity or cavities. The anvil is then removed from its position over the die cavity or cavities and is replaced by the pick-up head by a further angular motion of the work station positioner transversely across the face of the die plate. The punches are displaced upwardly so as to bring their upper ends in substantial flush alignment with the upper surface of the die plate, such that the finished compacted articles are ejected from the die cavities and picked up by the pick-up head. As the result of a return angular motion of the work station positioner to the initial fill position, the pick-up head is removed from over the die cavity and is disposed over one or, if a plurality of die cavities are employed, a series of discharge apertures arranged in a disposition similar to the arrangement of the die cavities in the die plate, and the finished compacted article or articles are drawn, as by vacuum, through the discharge aperture or apertures into a container or separate containers.

In copending applications, Ser. Nos. 619,855 and 761,003, which is a continuation of application Ser. No. 619,898, now abandoned, filed of even date herewith, tooling arrangements for compacting articles from powder material are described in which a mold cavity is defined partly by the end face of an upper punch projecting through an anvil element above the die cavity, partly by the die bore wall and partly by the end face of the lower punch.

SUMMARY OF THE INVENTION

The present invention provides improved tooling for compacting articles made of powder materials. The present invention accomplishes its objects by providing a molding apparatus for compacting powder material in the form of a die having a center bore, an upper punch reciprocally movable along the axis of the die bore from a position above the surface of the die to a position whereby the lower face of the upper punch abuts the surface of the die, the lower face of the upper punch defining the upper wall of a mold cavity, and a lower punch reciprocally movable in the center bore of the die and capable of compressing powder material positioned in the center bore into the mold cavity by an upward-directed stroke of the lower punch. The present invention contemplates coating the portion of the mold cavity defined by the upper punch with an elastomeric material, or alternatively, making the upper punch end portion of an elastomeric material. The articles compacted by the present invention are made within close dimensional tolerances and have a structure having a substantially improved uniform density as compared to articles obtained by more conventional compacting apparatus having solid mold walls.

DESCRIPTION OF THE PREFERRED EMBODIMENT

Figure 1:
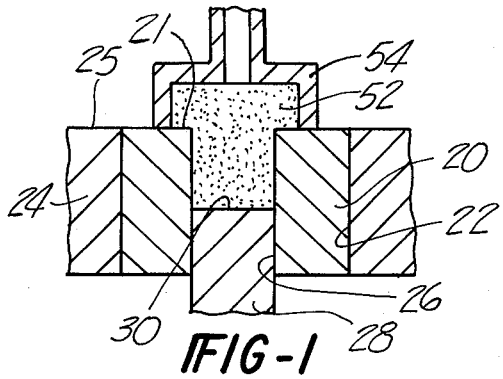
FIG. 1 is a broken sectional view of a die and lower punch according to the present invention showing the charging of powder material into the die cavity.

Referring now to FIGS. 1–4, there is shown, in a schematic manner, an apparatus according to the present invention for molding a generally pyramidal article. The molding apparatus comprises a die consisting of a die bushing 20 press-fitted, cemented or otherwise disposed in a bore 22 in a die plate 24. The die bushing 20 is preferably made of a hard material, such as tungsten carbide or the like, and the die plate 24 may be made of a tool steel, but is preferably also made of a carbide with a highly polished upper surface 25. The die bushing 20 is provided with a longitudinal bore 26 accepting for reciprocation therein a lower punch 28. In the example of structure illustrated, the lower punch 28 has a flat end face 30.

The lower punch 28 is reciprocable by means of an appropriate ram 29 (FIG. 2) forming a part of the press apparatus not shown, as disclosed in detail in the aforementioned patents, and an upper punch member 32, or counterpunch, (FIGS. 2–4) is provided reciprocable towards, and away from, the die plate 24 and die bushing 20 by being mounted on the end of a ram 33, reciprocated by appropriate means by the press mechanism, not shown, as disclosed, for example, in aforementioned U.S. Pat. No. 3,826,599. The end face of the upper punch 32 is provided with a cavity 34.

The wall of the cavity 34 defined by the lower face of the upper punch 32 is coated with an adhering layer 36 of elastomeric material. The layer 36 can vary in thickness from about one thousandth of an inch to several thousandths of an inch. It is composed of elastomeric materials which, in addition to natural rubber, may be such elastomers as neoprene, polysiloxane elastomers, polyurethane, polysulfide rubber, polybutadiene, buna-S, etc.

Figure 2:
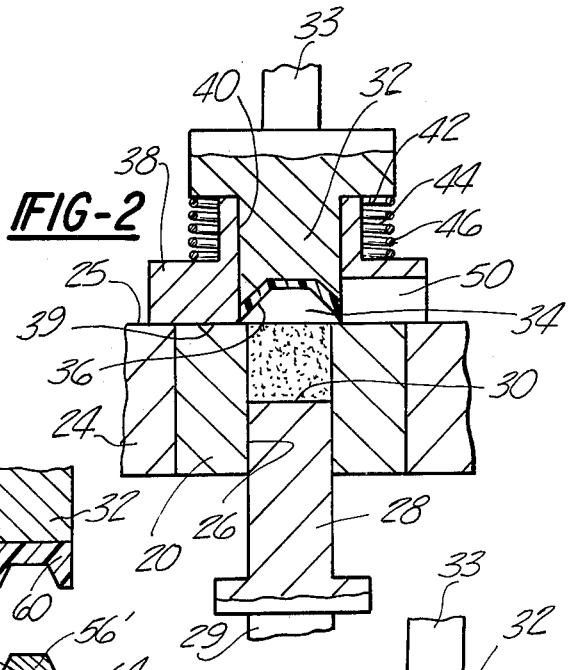
FIG. 2 is a broken sectional view of the apparatus in accordance with the present invention showing the upper punch clamped over the die cavity prior to the powder material compaction step.
Figure 3:
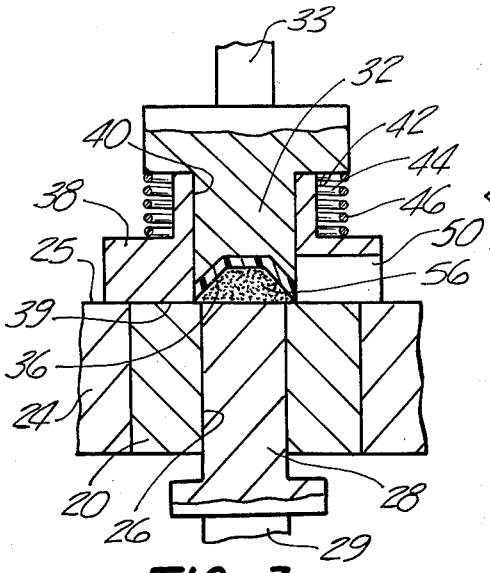
FIG. 3 is a broken sectional view similar to FIG. 2 but with the lower punch in the position is occupies after compaction of the material.
Figure 4:
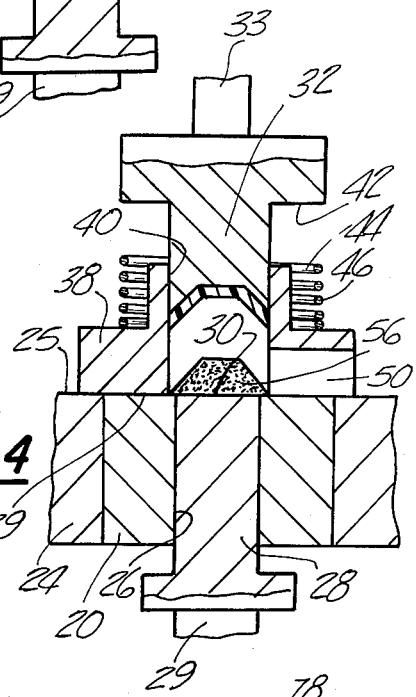
FIG. 4 is a broken sectional view similar to FIG. 2 but with the upper punch withdrawn after compaction of the material.
Figure 5:
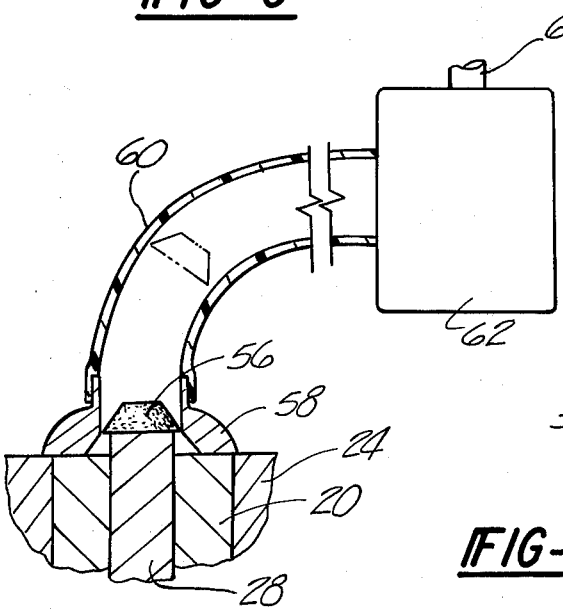
FIG. 5 is a broken sectional view of the die and lower punch with the lower punch in ejection position and article pick-up head in place.

When reciprocated towards and away from the die plate 24, the upper punch 32 is guided by an anvil member 38, having a lower surface 39 at all times in engagement with the upper surface 25 of the die plate 24, but displaceable from positions away from over the die cavity to a position over the die cavity, the latter position being illustrated at FIGS. 2–4. The upper punch 32 is reciprocable through a vertically disposed bore 40 in the anvil member 38, and has an abutment surface 42 engageable with the top end surface 44 of a coil spring 46, or other biasing means such as superimposed Belleville srings or the like, disposed over a reduced diameter portion 48 of the anvil member 38.

A radial slot 50 is disposed through the wall of the anvil member 38 to provide appropriate clearance for the finished part, when the anvil member 38 is laterally displaced from above the die cavity by means of the operation of the station positioner of the press apparatus as disclosed and explained in detail in the hereinbefore referred to patents, and more particularly U.S. Pat. Nos. 3,726,622; 3,645,658; 3,574,892; 3,561,056 and 3,145,142.

DESCRIPTION OF OPERATION

In operation, the die cavity is gravity filled with powder material 52 as illustrated at FIG. 1 by means of a powder hopper 54 disposed over the die cavity. During filling of the die cavity with powder material, the lower punch 28 is retracted so as to draw into the cavity an appropriate amount of powder material 52.

Subsequent to filling of the die cavity with powder material, the powder hopper 54 is laterally displaced, with the result that the edge of the powder hopper 54, in contact with the upper surface 25 of the die plate 24 and the end face 21 of the die bushing 20, wipes the surfaces clean of any powder particles and at the same time levels the charge of powder material 52 evenly flush with the end face 21 of the die bushing 20. The anvil member 38, supported and driven by the station positioner of the press apparatus, is then displaced to its position over the die cavity, and the upper punch 32 is advanced by the ram 33 into the guiding bore 40 of the anvil member 38, thus compressing the spring 46 and forcing firmly the anvil member against the die plate 24 until the end face of the upper punch 32 engages the end face 21 of the die bushing 20, as represented at FIG. 2.

Although not absolutely necessary for successful operation of the apparatus of the invention, the height of the anvil member 38 and the length of the upper punch 32 are preferably equal, such that, in the position shown at FIG. 2, the punch abutment surface 42 engages the top end surface of the anvil member, therefore applying the anvil member lower face 36 with great pressure against the die plate surface 25.

The lower punch 28 is then advanced to the position indicated at FIG. 3, i.e., until the end face 30 of the lower punch is flush with the surface 21 of the die bushing 20, thus compacting the powder material 52 into the article 56. The press apparatus is adjusted such that the force applied for reciprocating the lower punch 28 is slightly smaller than the force holding the upper punch 32 with its end in engagement with the die bushing end face 21. The upper punch 32 is subsequently withdrawn from within the bore 40 in the anvil member 38, as illustrated at FIG. 4, and the anvil member 38 is laterally displaced to a position away from above the die cavity, the slot 50 in the wall of the anvil member providing appropriate clearance for the article 56 during displacement of the anvil member.

A vacuum pickup head 58, also supported by the press apparatus station position, is subsequently placed above the die cavity, and the lower punch 28 is advanced upwardly such as to eject the article 56 into the vacuum pickup head 58 and through a pipe 60 to a container 62 connected to a source of vacuum, not shown, via a line 64.

It will be appreciated that other means of ejecting the finished part, such as mechanical wiper means or vacuum pickup heads provided with a screen to which the finished articles remain adhering until the pickup head is displaced over an appropriate ejection aperture through the die plate communicating with an appropriate receptacle, may also be used in conjunction with the apparatus of the invention as disclosed in the aforementioned patents.

Figure 6:
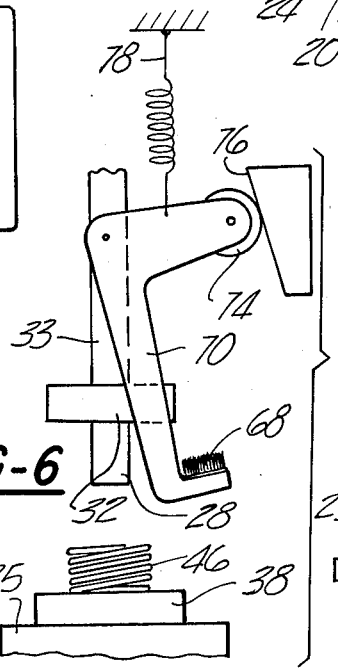
FIGS. 6 and 7 are schematic partial elevation views of means for cleaning the end face of the upper punch shown respectively in the advanced and retracted positions of the upper punch.
Figure 7:
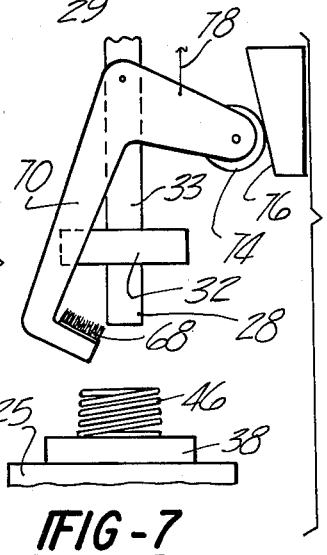

It has been discovered that when forming certain types of powder material into compacted articles, according to the present invention, some powder particles may find their way between the upper punch end face 36 and the end face 21 of the die bushing 20. The die bushing end face 21 is kept clean by the wiping action of the powder dispenser edge and, in order to prevent an accumulation and build-up of powder particles on the end face of the upper punch 32, especially in structures in which said end face presents an annular surface in engagement with the surface 21, means may be provided, as illustrated at FIGS. 6–7, for wiping the end face of the punch clean between compacting operations. As illustrated, such wiping operation is effected by means of a vacuum brush 68, having a length corresponding substantially to the diameter of the punch 32, mounted on the end of an arm 70 pivotable about a pivot point 72 disposed on a side of the upper ram 33. A cam follower 74 supported on one side of the arm 70 is engageable with a stationary cam surface 76 when the ram 33 and the punch 32 are reciprocated, so as to move the vacuum brush 68 from the position shown at FIG. 6 when the upper punch 32 is advanced, to the position shown at FIG. 7 when the upper punch is retracted. Appropriate biasing means, such as a spring 78, are provided for urging the arm 70 and the brush 68 in the position shown at FIG. 6, such that during reciprocation of the upper punch 32, the vacuum brush 68 is caused to traverse the face of the punch, thus removing any powder material that may remain adhering to the punch face. Other convenient means, such as the rotary brush arrangement disclosed in Pat. No. 3,328,840, may be used for wiping clean the end face of the upper punch.

Figure 8:
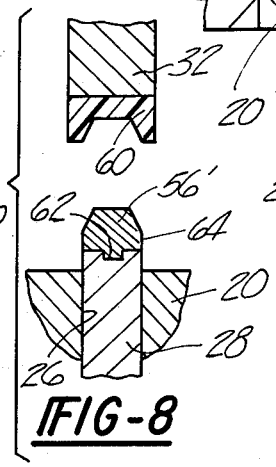
FIG. 8 is a schematic partial representation of a modification of the invention and of the corresponding article made thereby.

It will be readily appreciated that the compacting apparatus of the present invention may be modified to provide compacted articles other than the article 56. Also, the end face of the upper punch may be provided with a section 60 made entirely of elastomeric material, as schematically shown at FIG. 8, and the end face of the lower punch may be provided with any desired shape such as forming a cavity 62, such that the compacted article 56' has a shape depending from the shape of the upper and lower punch end faces. In addition, and also as illustrated at FIG. 8, a portion of the compacted article 56' may be molded within the die bore, as shown at 64, such that part of the periphery of the article conforms to the shape of the die bore wall.

The upper and lower punches are made of heat treated and ground tool steel, or preferably metallic carbide, such as tungsten carbide of the like7 The elastomeric material portion of the mold is preferably cemented to the surface of the metallic punch.

It is to be understood that the example of the present invention as disclosed herein constitutes one preferred form and that other forms might be adopted. Consequently, the shape of compacted articles herein illustrated should not be considered unduly limiting, but should include other shapes within the spirit of the invention and the scope of the appended claims.

I claim:

1. An apparatus for compacting powder material into a compacted article, said apparatus comprising a stationary die plate, a die in said die plate having a vertically disposed bore and an upper surface, a first punch reciprocably movable in said bore and having an upper end face, a second punch laterally displaceable to a position in axial alignment with said die bore, said second punch being reciprocably movable for overlappingly closing said bore upper end and having a lower end face provided with a cavity overlapping said bore, said cavity being closed by the end face of said first punch when in flush relation with said die upper surface and defining therewith a mold for compacting said powder material by displacement of said first punch toward said second punch, wherein at least part of said mold formed by said cavity is made of elastomeric material, support and guide means for said second punch provided with an end surface for engagement with said die plate, means for applying a clamping force to said second punch in engagement with said die plate upper surface with said cavity overlapping said bore, abutment means on said second punch for engagement with said support and guide means for transmitting said clamping force to said support and guide means, means for retracting said second punch away from said die upper surface, and a slot in said support and guide means for clearing said compacted article projecting above said die upper surface during lateral displacement of said second punch and said support and guide means after retraction of said second punch.

2. The apparatus of claim 1 wherein said clamping force is transmitted by said abutment to said support and guide means by spring bias means.

3. The apparatus of claim 1 further comprising means cleaning said second punch end face from powder particles when said end face is disengaged.

4. The apparatus of claim 1 wherein said first punch compacting face has a cavity therein.

5. The apparatus of claim 1 wherein said bore is in a die bushing disposed in said die plate and the end each of said second punch is engageable with an end of said bushing.

* * * * *

UNITED STATES PATENT AND TRADEMARK OFFICE

CERTIFICATE OF CORRECTION

PATENT NO. : 4,061,453

DATED : December 6, 1977

INVENTOR(S) : Raymond P. DeSantis

It is certified that error appears in the above-identified patent and that said Letters Patent are hereby corrected as shown below:

Column 2, line 13, change "whereby" to --where--.

Column 2, line 39, change "is" to --it--.

Column 3, line 35, change "srings" to --springs--.

Column 3, line 51, after "the" insert --die--.

Column 4, line 8, after "plate" insert --upper--.

Column 4, line 63, after "punch" insert --32--.

Column 5, line 22, change "like7" to --like.--.

Signed and Sealed this

*Fourth* Day of *April 1978*

[SEAL]

*Attest:*

RUTH C. MASON
*Attesting Officer*

LUTRELLE F. PARKER
*Acting Commissioner of Patents and Trademarks*